US007094188B2

(12) United States Patent
Reitz et al.

(10) Patent No.: US 7,094,188 B2
(45) Date of Patent: Aug. 22, 2006

(54) LOW-RESISTANCE EXERCISE AND REHABILITATION CHAIR

(76) Inventors: Alan S. Reitz, 302 Buchanan St., Staunton, VA (US) 24401; Paxton P. Powers, 2201 Harbourside Dr., New Bern, NC (US) 28560; Ronald O. Browne, 47 Lockheed Blvd., Waynesboro, VA (US) 22980

( * ) Notice: Subject to any disclaimer, the term of this patent is extended or adjusted under 35 U.S.C. 154(b) by 0 days.

(21) Appl. No.: 10/716,510

(22) Filed: Nov. 20, 2003

(65) Prior Publication Data

US 2004/0152572 A1 Aug. 5, 2004

Related U.S. Application Data

(63) Continuation-in-part of application No. 10/147,666, filed on May 17, 2002, now Pat. No. 6,855,098.

(51) Int. Cl.
*A63B 26/00* (2006.01)

(52) U.S. Cl. ..... 482/142; D21/690

(58) Field of Classification Search ..... 482/142, 482/908, 140, 1, 148; 297/68, 258.1, 65; D6/334; D12/52; D21/686, 676, 690, 52; 128/25, 898; 606/242

See application file for complete search history.

(56) References Cited

U.S. PATENT DOCUMENTS

| | | | | |
|---|---|---|---|---|
| 21,536 | A * | 9/1858 | Holmes | 297/72 |
| 2,233,797 | A * | 3/1941 | Potter | 297/68 |
| 4,723,537 | A | 2/1988 | Parker, Jr. | 128/25 R |
| 4,827,913 | A | 5/1989 | Parker | 128/25 R |
| 4,836,536 | A * | 6/1989 | Jones | 482/134 |
| 4,921,247 | A | 5/1990 | Sterling | 272/136 |
| 5,163,451 | A | 11/1992 | Grellas | 128/898 |
| 5,258,019 | A * | 11/1993 | Riddle et al. | 606/242 |
| 5,383,712 | A | 1/1995 | Perry | 297/448 |
| 5,865,457 | A | 2/1999 | Knabusch et al. | 280/304.1 |
| 5,931,535 | A * | 8/1999 | Sweet | 297/354.13 |
| 6,135,554 | A * | 10/2000 | Tsun et al. | 297/327 |
| 2003/0193219 | A1 * | 10/2003 | Garland | 606/242 |
| 2004/0094936 | A1 * | 5/2004 | Koerlin | 280/650 |

* cited by examiner

*Primary Examiner*—Lori Amerson
(74) *Attorney, Agent, or Firm*—Jacobson Holman PLLC

(57) ABSTRACT

An exercise and rehabilitation chair and method includes pivotal front support legs, rigid rear legs, a seat assembly having a seat bottom and seat back and upper and lower arms, each upper and lower arm being pivotally coupled at a rearward end to a pivotal support arm rigid with a seat back and at a forward end to an upper end of a pivotal front leg. Bearing structures pivotally connect corresponding support arms and rear legs and establish a fulcrum about which the seat assembly may rotate. The bearing structures are simultaneously adjustable longitudinally along the pivotal support arms and rigid rear legs with displacement of the fulcrum relative to a user's hips regulating the resistance of chair operation. A foot assembly is pivotally coupled to the front legs and the forward ends of the upper and lower arms. All pivotal connections correspond anatomically to a user's joints for low joint stress and low-resistance exercise.

14 Claims, 10 Drawing Sheets

LOW-RESISTANCE EXERCISE AND REHABILITATION CHAIR

RELATED APPLICATION

This application is a continuation-in-part of application Ser. No. 10/147,666 filed May 17, 2002, now U.S. Pat. No. 6,855,098 issued Feb. 15, 2005, the disclosure thereof being incorporated by reference as if fully set forth herein.

BACKGROUND OF THE INVENTION

This invention relates generally to exercise and rehabilitation equipment and, more particularly, to a chair having multiple pivot points corresponding generally to a person's joints for low-resistance, high-repetition exercise and rehabilitation and the methods of chair operation and rehabilitation exercise.

Elderly and disabled persons, persons confined to a small apartment or room, and persons recovering from injury, illness, or surgery frequently experience increased weakness and lack of steadiness and mobility. Lack of activity due to arthritis pains, senile dementia, and the like may also result in decreased strength end endurance. This weakening process may become a permanent physical limitation, result in falls, or require medical intervention, prolonged physical therapy, or living assistance.

Various exercise devices are known in the art for increasing muscle strength and aerobic endurance. Although assumably effective for their intended purposes, the existing devices may result in muscle soreness and joint pain as well as being difficult for the elderly or disabled to operate.

Therefore, it is desirable to have an exercise and rehabilitation chair having multiple pivot points that operate a user's joints using low-resistance and high repetition movements, without the user's body weight being applied to the joints, as is obvious by the user's sitting position. Further, it is desirable to have an exercise and rehabilitation chair in which resistance may be regulated by adjusting the vertical position of the fulcrum about which the seat assembly pivots. It is also desirable to have an exercise and rehabilitation chair in which the fulcrum may alternatively be adjusted using electrically actuated gear assemblies.

SUMMARY OF THE INVENTION

Accordingly, a low-resistance exercise and rehabilitation chair according to the present invention includes a framework having a pair of lower frame members with a pair of front legs pivotally coupled to front ends thereof. A pair of A-frame supports are fixedly attached to respective lower frame members with one rear leg extending higher than the other. The chair includes a seat assembly having a pair of upper arms. A front end of each upper arm is pivotally coupled to upper ends of respective front legs. Rear ends of the upper arms are pivotally coupled to respective generally upstanding support arms. The support arms are pivotally coupled to the rigid rear legs so as to establish a fulcrum about which the seat assembly may pivot in operation. The fulcrum is positioned generally only slightly above the hips of a user, the resistance of operation being easier the closer the fulcrum is to the hips and vice versa. Bearing housings mounted to the support arms and rigid rear legs are adapted to allow this fulcrum to be vertically adjusted.

A foot assembly is pivotally coupled to the front legs and includes a foot plate. Application of foot pressure against the foot plate along with back pressure against the seat back of the seat assembly causes the pivotal action/rocking motion of the seat assembly. Pivot points at the junction of the front legs and upper arms of the seat assembly, at the junction of the front legs and foot assembly, and at the junction of the seat bottom and seat back are configured to correspond most particularly with the knee and hip joints of a user.

In addition, the configuration of the fulcrum just above the hips of a user reduces resistance during operation. The pivotal attachment of the front legs to respective rigid lower frame members also contributes to the smooth, low-resistance operation of the apparatus. Since the configuration of the chair does not stress a user's joints and provides low resistance due to the proximity of the fulcrum to the user's hips, the chair provides exercise or rehabilitation to a user without the joint and muscular disadvantages of conventional exercise equipment.

Therefore, a general object of this invention is to provide a chair that improves the strength and endurance of a user as well as a practical and useful piece of furniture.

Another object of this invention is to provide a chair, as aforesaid, having an axis of rotation for repeated forward and backward rotational movements of a seat assembly.

Still another object of this invention is to provide a chair, as aforesaid, having pivot points aligned and configured to correspond with the axis of rotation of a user's knees and hips.

Yet another object of this invention is to provide a chair, as aforesaid, in which a fulcrum defining an axis of rotation of a seat assembly may be vertically adjusted relative to the hips of a user so as to increase or decrease operational resistance.

A further object of the present invention is to provide an exercise chair especially adapted for use by elderly users or those with impaired mobility and requires active participation by the user to effectively improve strength and endurance by repetitive movement overcoming a low resistance.

A still further object of the invention is to provide an exercise chair that is easy to use and constructed to enable a user to easily gain access to and-exit from the chair.

Yet a further object of the invention is to provide an exercise chair in accordance with the preceding objects in which the chair includes a supporting linkage structure having a forward pivot axis corresponding to and generally aligned with the anatomical pivot axis of the knees of a user and a rearward pivot axis corresponding to and generally aligned with the anatomical hip joint of a user.

Still another object of the present invention is to provide a method of operation for a rehabilitation chair which imparts a low resistance to the user at the points of rotation in order to permit high frequency operation.

Still a further object of the present invention is to provide a method of low-resistance, high-frequency exercise for the hip and knee joints in an exercise chair.

Other objects and advantages of this invention will become apparent from the following description, taken in connection with the accompanying drawings, wherein is set forth by way of illustration and example, embodiments of this invention.

DESCRIPTION OF THE PREFERRED EMBODIMENTS

Figure 1:
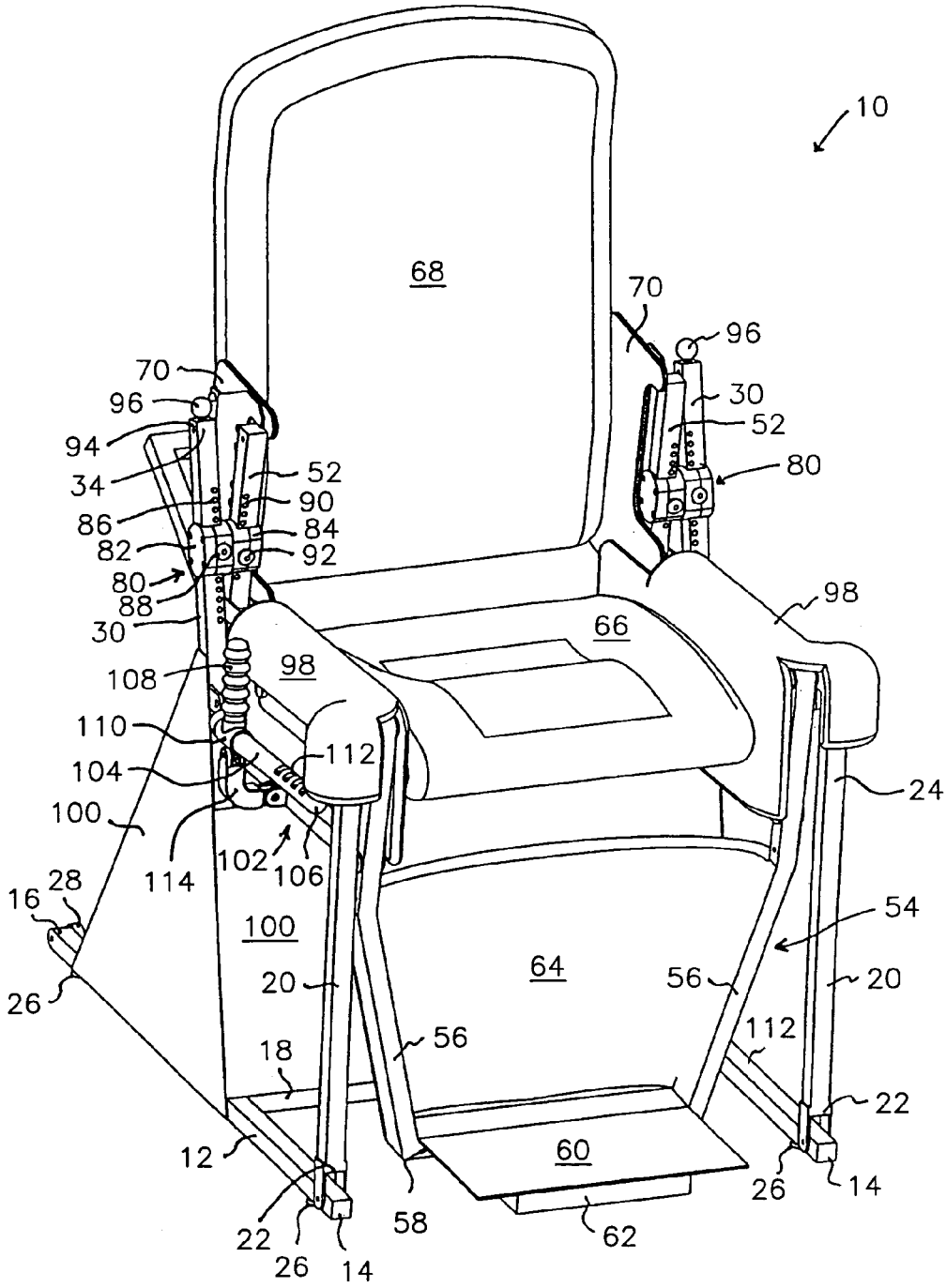
FIG. 1 is a perspective view of an exercise and rehabilitation chair according to an embodiment of the present invention.

Although two preferred embodiments of the invention are explained in detail, it is to be understood that the invention is not limited in its scope to the details of construction and arrangement of components of these specific embodiments. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

One embodiment of the low-resistance and rehabilitation chair according to the present invention is described in detail with reference to FIGS. 1 through 4 of the accompanying drawings. More particularly, the chair framework includes a pair of laterally spaced apart lower frame members 12 configured to extend along a floor surface. The lower frame members 12 may be connected by struts 18 for stability (FIG. 3). Each lower frame member 12 includes opposed front 14 and rear 16 ends. The chair framework further includes a pair of generally upstanding front legs 20, each front leg having a lower end 22 pivotally coupled to a respective front end 14 of a respective lower frame member 12. This pivotal connection allows an upper end 24 (FIG. 3) of each front leg 20 to move simultaneously in forward and rearward directions during operation.

Level adjustment feet 26 are coupled to the bottom surfaces of the lower frame members 12 in spaced apart arrangement. In addition, at least a pair of wheels 28 are rotatably coupled to the lower frame members 12 adjacent respective rear ends 16 thereof (FIG. 3). Thus, the chair 10 may be tipped backwards and rolled upon the wheels 28 to a desired location.

Figure 2:
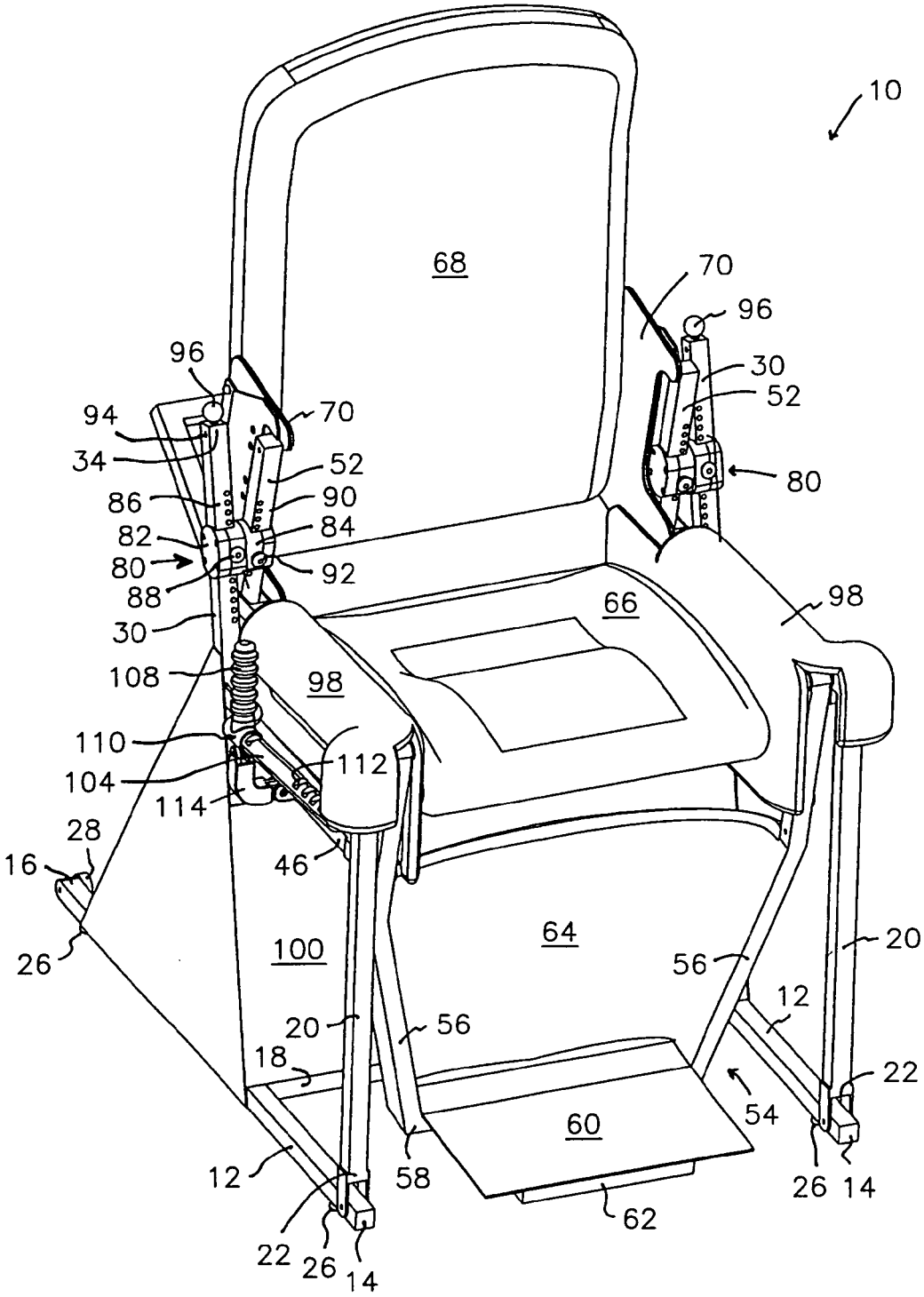
FIG. 2 is another perspective view of the chair as in FIG. 1 with the seat assembly in a rotated forward configuration.
Figure 3:
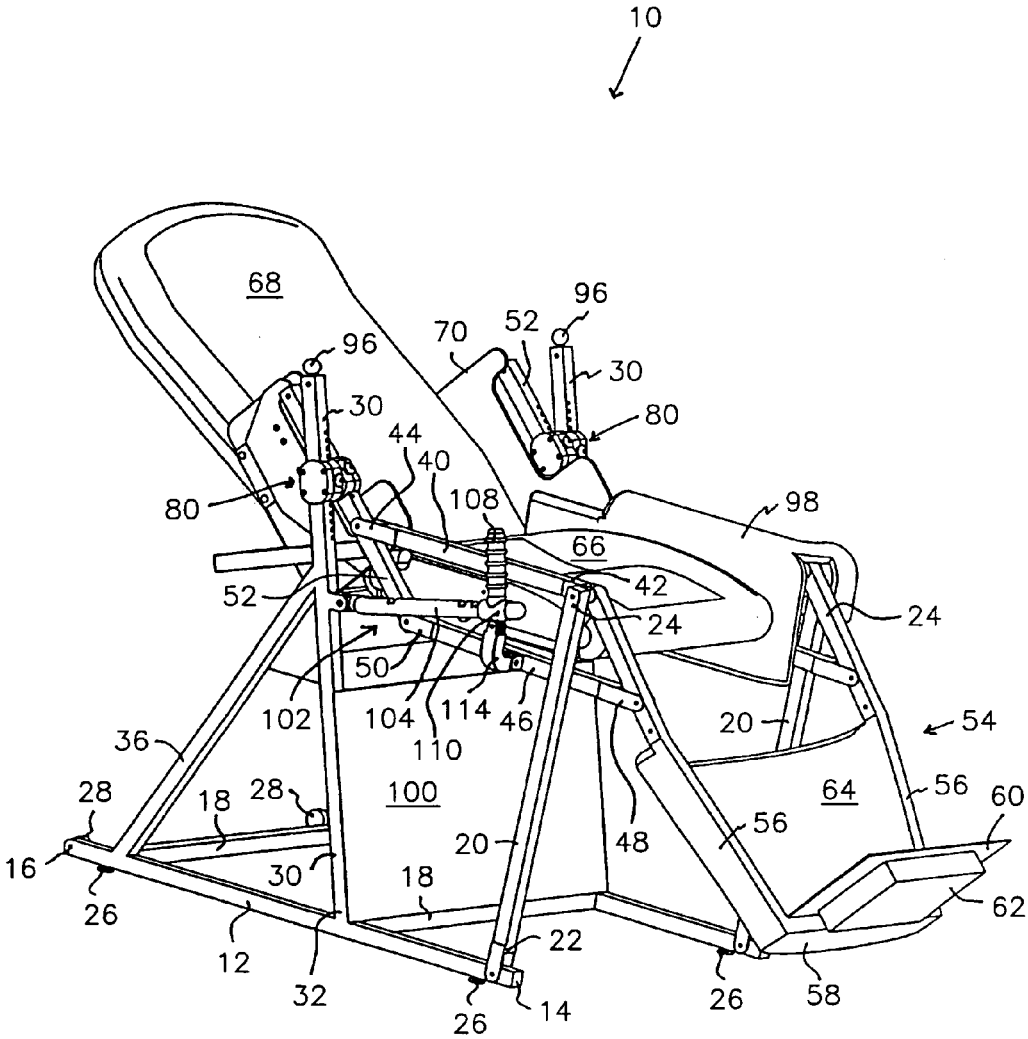
FIG. 3 is another perspective view of the chair as in FIG. 1 with the seat assembly in a rotated rearward configuration and with one armrest and side shield removed.

The chair framework further includes a pair of generally upstanding rear legs 30, each rear leg 30 having one end 32 fixedly attached to a respective lower frame member 12 at a point intermediate front 14 and rear 16 ends thereof and having an opposed free end 34 (FIG. 2). An auxiliary rear leg 36 extends between each rear leg 30 and a point adjacent a rear end 16 of a respective lower frame member 12 so as to form an A-frame support structure on each lower frame member 12 (FIG. 3).

As best shown in FIG. 3, the seat assembly includes pairs of upper 40 and lower 46 arms. Each upper arm 40 includes a front end 42 pivotally coupled to an upper end 24 of a respective front leg 20 with a bushing or similar fastener and includes a rear end 44. This point corresponds to the user's knee joint. Each lower arm 46 includes opposed front 48 and rear 50 ends. The seat assembly further includes a pair of generally upstanding support arms 52, each support arm having a lower end and an opposed free end. The lower end of each support arm 52 is pivotally coupled to a rear end 50 of a respective lower arm 46. A rear end 44 of each upper arm 40 is pivotally coupled to a respective support arm 52 at a point intermediate the lower and free ends thereof. This point corresponds to the user's hip joint.

The seat assembly includes a foot assembly 54 having a framework. The foot assembly framework includes a pair of lateral support bars 56, each lateral support bar being pivotally connected at one end to a front end 42 of a respective upper arm 40 of the seat assembly. Each lateral support bar 56 is further pivotally coupled to a front end 48 of a respective lower arm 46. The lateral support bars 56 are connected at opposed ends by a lower support bar 58. A planar foot plate 60 is attached to the lower support bar 58 and is configured to support the feet of a user. A weight 62 is fixedly attached to a bottom side of the foot plate 60 for counterbalancing the weight of the rearward portion of the seat assembly, as to be described more fully below. A shield 64 may also extend between the lateral support bars 56 so as to keep a user's feet properly positioned upon the foot plate 60 in operation. Further, it is contemplated that the foot plate 60 may be adjustable longitudinally along the lateral support bars 56 such that the chair 10 may be used by persons of various heights.

Therefore, each pair of upper 40 and lower 46 arms are pivotally coupled at respective ends to the foot assembly 54 and upstanding support arms 52 so as to form a parallelogram whose configuration changes in angular relationship during operation of the chair 10. Further, the seat assembly includes a padded seat bottom 66 fixedly attached to the upper arms 40. In addition, a seat back 68 is fixedly attached to the upstanding support arms 52 with mounting brackets 70.

Figure 4:
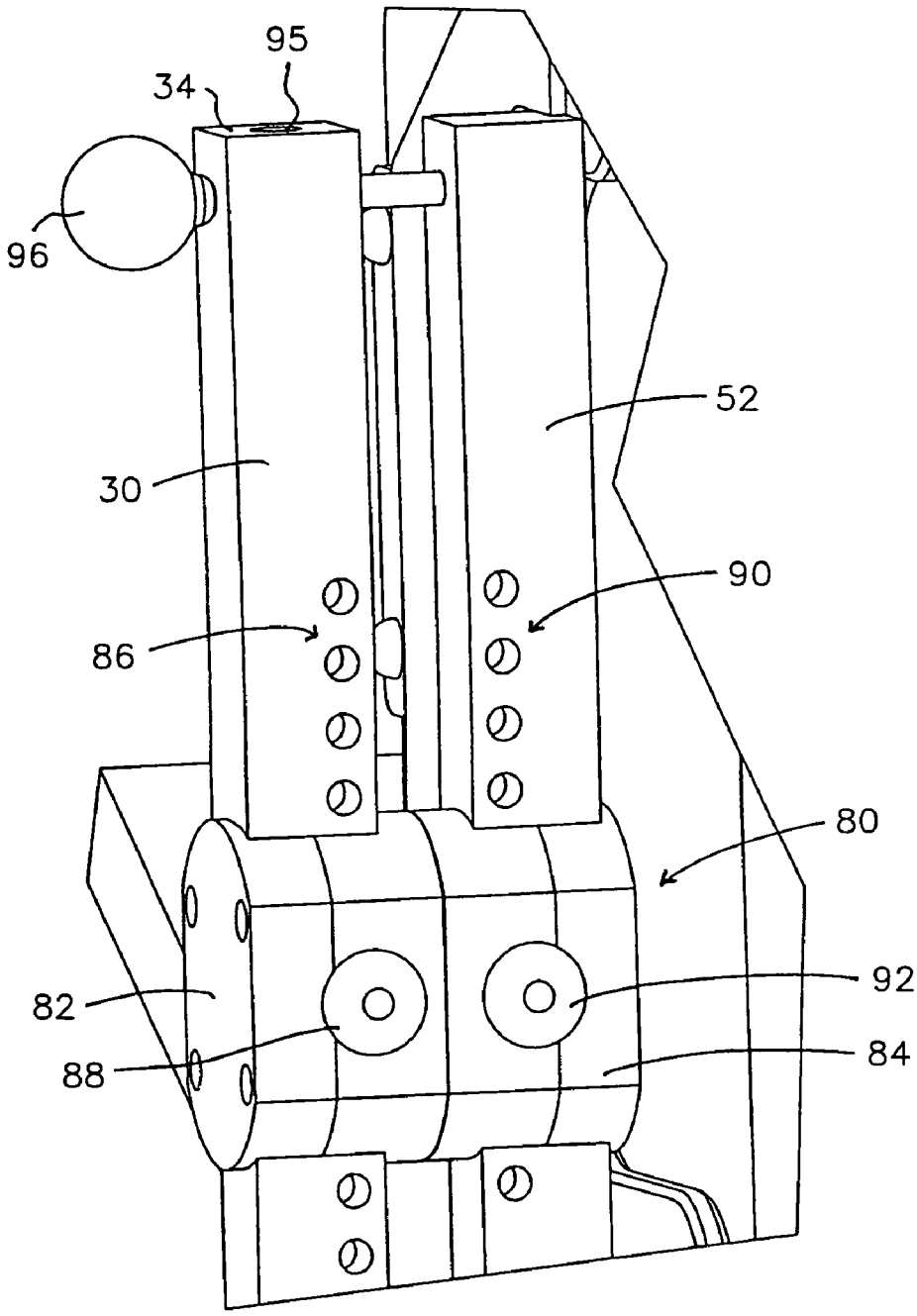
FIG. 4 is a fragmentary view on an enlarged scale of a bearing housing mounted to a rear leg and corresponding support arm while said rear leg and support arm are coupled together in a stationary configuration.

As best shown in FIG. 4, the chair 10 includes a pair of bearing housings 80, each bearing housing 80 having a first portion 82 mounted to a respective rear leg 30 and a second portion 84 mounted to an adjacent corresponding upstanding support arm 52. Each second portion 84 is pivotally coupled to a respective first portion 82 such that the second portions 84 of the bearing housings 80, through which respective support arms 52 of the seat assembly extend, establish a fulcrum about which the seat assembly may rotate, as to be described more fully later. Each bearing housing 80 is slidably movable along a corresponding rear leg 30 and to support arm 52 combination. More particularly, each rear leg 30 defines a first plurality of holes 86 spaced apart longitudinally therealong and spaced from free ends 34 thereof. Correspondingly, a first pair of fasteners 88 extend through respective first portions of the pair of bearing housings 80 and are adapted to extend into a selected hole. Preferably, each first fastener 88 is a spring-loaded plunger pin biased to extend into a selected hole but that may be manually released therefrom by a user so as to slidably move a respective first portion 82 along a respective rear leg 30.

Similarly, each support arm 52 defines a second plurality of holes 90 spaced apart longitudinally therealong and spaced from free ends thereof. Correspondingly, a second pair of fasteners 92 extend through respective second portions of the pair of bearing housings 80 and are adapted to extend into a selected hole. The second pair of fasteners 92 are the same as those previously described.

It should be appreciated that corresponding first and second portions of a bearing housing 80 must be slidably moved together as corresponding portions are pivotally connected to one another. Further, the pair of bearing housings 80 should be positioned longitudinally at the same height such that the seat assembly is held in a level configuration. As discussed above, the bearing housings 80 define an imaginary horizontal axis extending therebetween so as to establish a fulcrum about which the seat assembly may rotate. This horizontal axis extends laterally across a vertical plane defined by the back of a user seated upon the seat bottom. Accordingly, moving this horizontal axis (fulcrum) up or down increases or decreases the resistance/difficulty of the chair's rotation, respectively. In other words, the closer the fulcrum is to a user's hips, the less resistance is encountered and vice versa. Preferably, the holes are configured so that the fulcrum may be adjusted from about three inches to about nine inches above a user's hips.

Each of the rear legs 30 and upstanding support arms 52 define laterally extending throughbores 94 (FIG. 1). Pins 96 may be extended through these bores 94 when corresponding rear legs 30 and support arms 52 are aligned in parallel and are stationary. Once secured, the seat assembly is held in a stable configuration. Pins 96 in FIG. 4 are used to secure the position and alignment of rear legs 30 and support arms 52 to allow the bearing housings 80 to be moved manually by pulling fasteners 88 and 92 simultaneously. When the pins 96 are removed, they may be stored in bores 95 extending longitudinally into free ends of the rear legs 30 (FIG. 4). It is understood that each pin 96 presents a length sufficient to act as a lever so as to raise and hold a corresponding support member 52 just enough to allow pins 88 and 92 to be released when adjusting the vertical position of a corresponding bearing housing 80. Of course, each pin 96 would be of sufficient length and diameter to accept the weight of the seat assembly while adjusting a corresponding bearing housing 80.

Further, the seat assembly includes a pair of padded armrests 98 adapted to overlay the upper arms 40 thereof. Preferably, the armrests 98 also overlay the connections of the upper arms 40 and front legs 20 and of the upper arms and lateral support bars of the foot assembly 54. While providing greater comfort to a user, the armrests 98 also serve to cover potential pinch points so as to avoid potential injury. Other pivotal connections are covered by shield panels 100.

The chair 10 further includes a handle assembly 102 (FIG. 1). The handle assembly 102 includes a support member 104 having a first end pivotally coupled to a respective rear leg 30and extending forwardly to a free end 106. This pivot coupling allows for up/down movement of the support member 104. The handle assembly 102 includes an upstanding handle 108 fixedly attached to a sleeve 110, the sleeve being slidable along the support member 104. The handle 108 includes a biased member (not shown) for mating with a selected aperture 112 defined by the support member 104, the biased member being selectively disengaged upon a rotation of the handle 108. One end of a bracket 114 is pivotally coupled to the sleeve 110 with another end of the bracket 114 being pivotally coupled to a respective lower arm 46 of the seat assembly. These pivot connections are configured so as to allow the support member 104 to move along any axis according to movement of the seat assembly. The handle assembly 102 is used to lock the motion of the chair for safely sitting upon and standing up from the chair, and also to allow the user to lock the chair in a reclined position for resting in comfort while not exercising.

In operation, the seat assembly rests in a generally upright configuration when no user is seated therein, the weight 62 attached to the foot plate 60 counterbalancing the weight of the seat back 68 (FIG. 1). The handle assembly 102 is used to allow the user to lock and unlock the motion of the chair. When handle 108 is rotated, releasing the lock, the user is able to cause a rotational movement similar to that of a rocking chair and thus recline the chair 10 by pushing their feet gently on the foot plate 60 and leaning backward against the seat back 68 (FIG. 3). Releasing each of these pressures allows the seat assembly to rotate forwardly (FIG. 2). The difficulty (resistance) of causing the chair 10 to rotate as described above depends on the relative position of the bearing housing 80 above the user's hips. Resistance is reduced the closer the bearing housings are to the user's hips. Operation of the chair 10 causes low resistance exercise and is gentle on a person's joints in that the pivot connections of the chair 10 correspond anatomically with the joints of the user's body.

Figure 5:
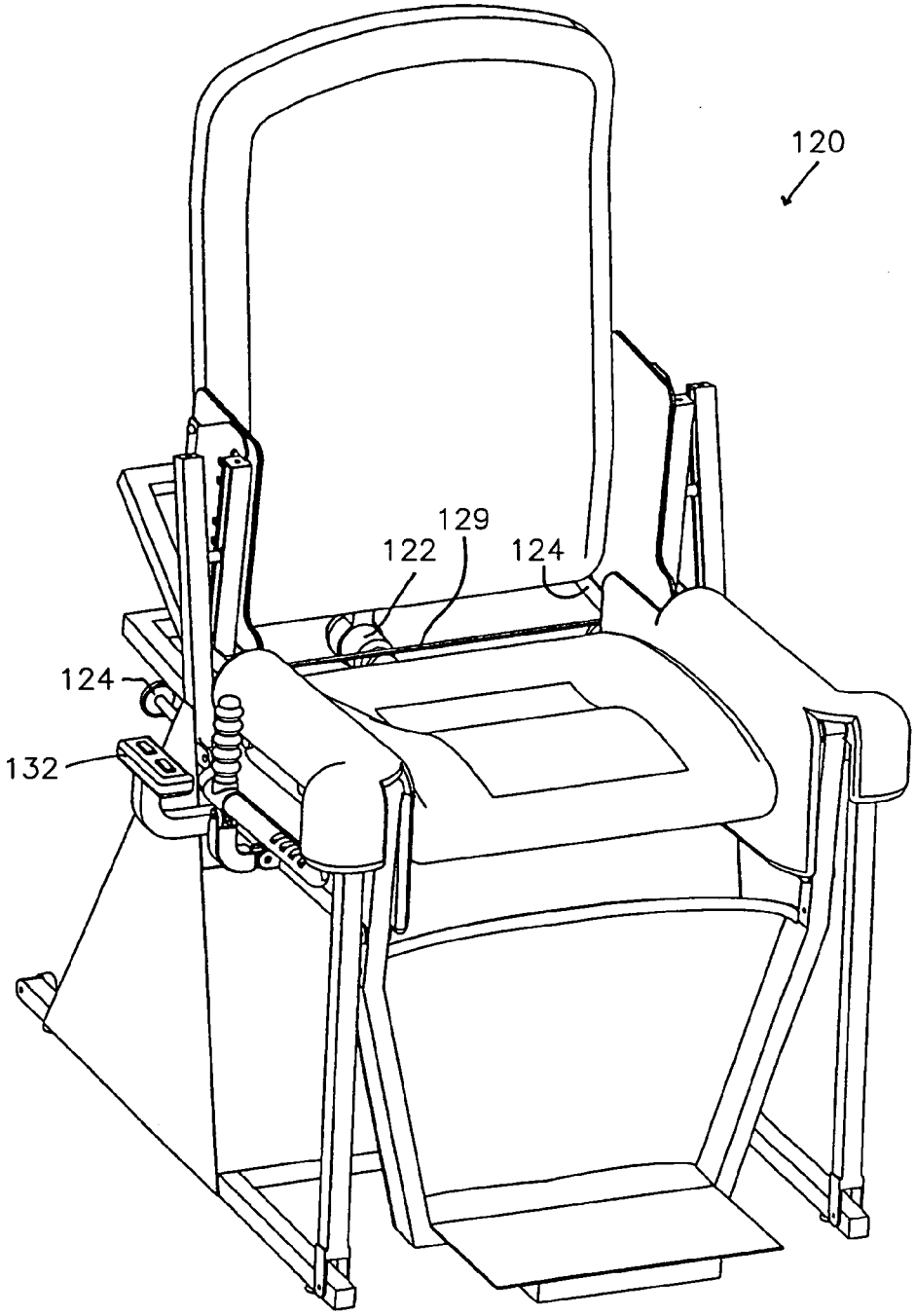
FIG. 5 is a perspective view of an exercise and rehabilitation chair according to another embodiment of the present invention.
Figure 6:
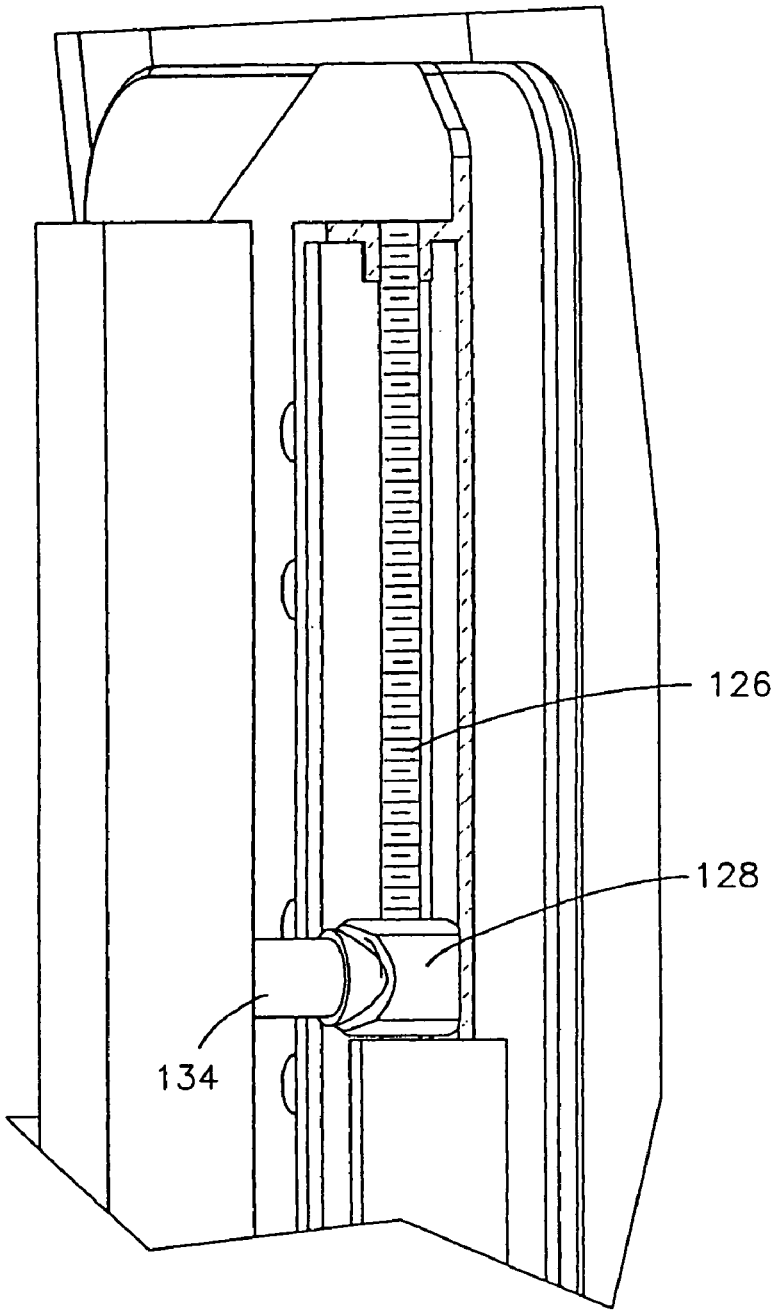
FIG. 6 is a fragmentary view on an enlarged scale of a jackscrew assembly of the chair as in FIG. 5.
Figure 7:
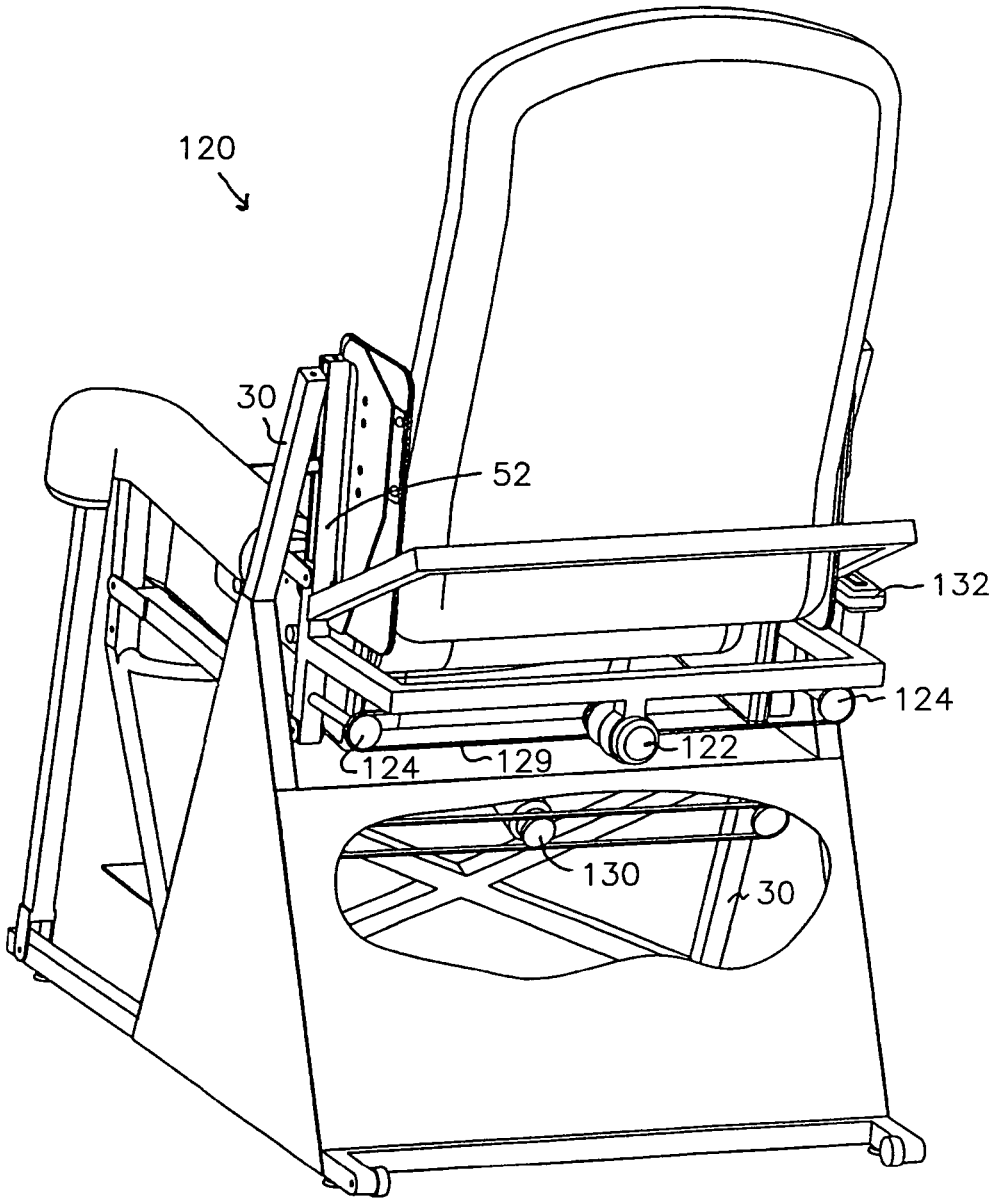
FIG. 7 is a rear perspective view of the chair as in FIG. 5 with a rear shield partially removed.

Another embodiment 120 of the present invention is shown in FIGS. 5 through 7 and includes a construction substantially similar to the construction described above except as specifically noted below. In this embodiment, a first jackscrew assembly is associated with each upstanding support arm 52 and is operated by a first motor 122. A second jackscrew assembly is associated with each rear leg 30 and is operated by a second motor 130. Operation of the jackscrew assemblies adjusts the fulcrum about which the seat assembly rotates. More particularly, each first jackscrew assembly includes a first gear 124 rotatably coupled to a respective support arm 52. Each of the first gears 124 is coupled to the first motor 122 with a first belt 129. Within a respective support arm 52, a respective first gear 124 meshes with a first jackscrew 126 which extends longitudinally therein, an operation of a first gear 124 causing the first jackscrew 126 to rotate about a longitudinal axis. Consequently, this jackscrew rotation causes a first adjustment bracket 128, that is in mating engagement with the threads of the first jackscrew 126, to be moved up or down therealong, depending on the direction of jackscrew rotation. The first motor 122 may be operated by a user utilizing the control panel 132 (FIG. 5). The motors may be powered using a conventional AC power connection (not shown). It is understood that operation of the first motor 122 operates the first jackscrew assemblies in unison.

The second jackscrew assembly includes a construction substantially similar to the construction of the first jackscrew assembly described above. The second jackscrew assembly is associated with the rear legs 30; thus, second jackscrews and second adjustment brackets are situated within respective rear legs. A fulcrum shaft 134 is coupled to corresponding first and second adjustment brackets so as to allow respective support arms 52 to rotate about the fulcrum shaft relative to corresponding rear legs 30 in a manner substantially similar to that described previously. It should be appreciated that the first 122 and second 130 motors operate simultaneously to adjust respective adjustment brackets. Therefore, an operation of the motors causes the fulcrum to be selectively raised or lowered so as to increase or decrease resistance of operation, respectively. It is understood that other motorized gear linkage arrangements could alternatively be employed for raising or lowering the fulcrum shafts.

Figure 8:
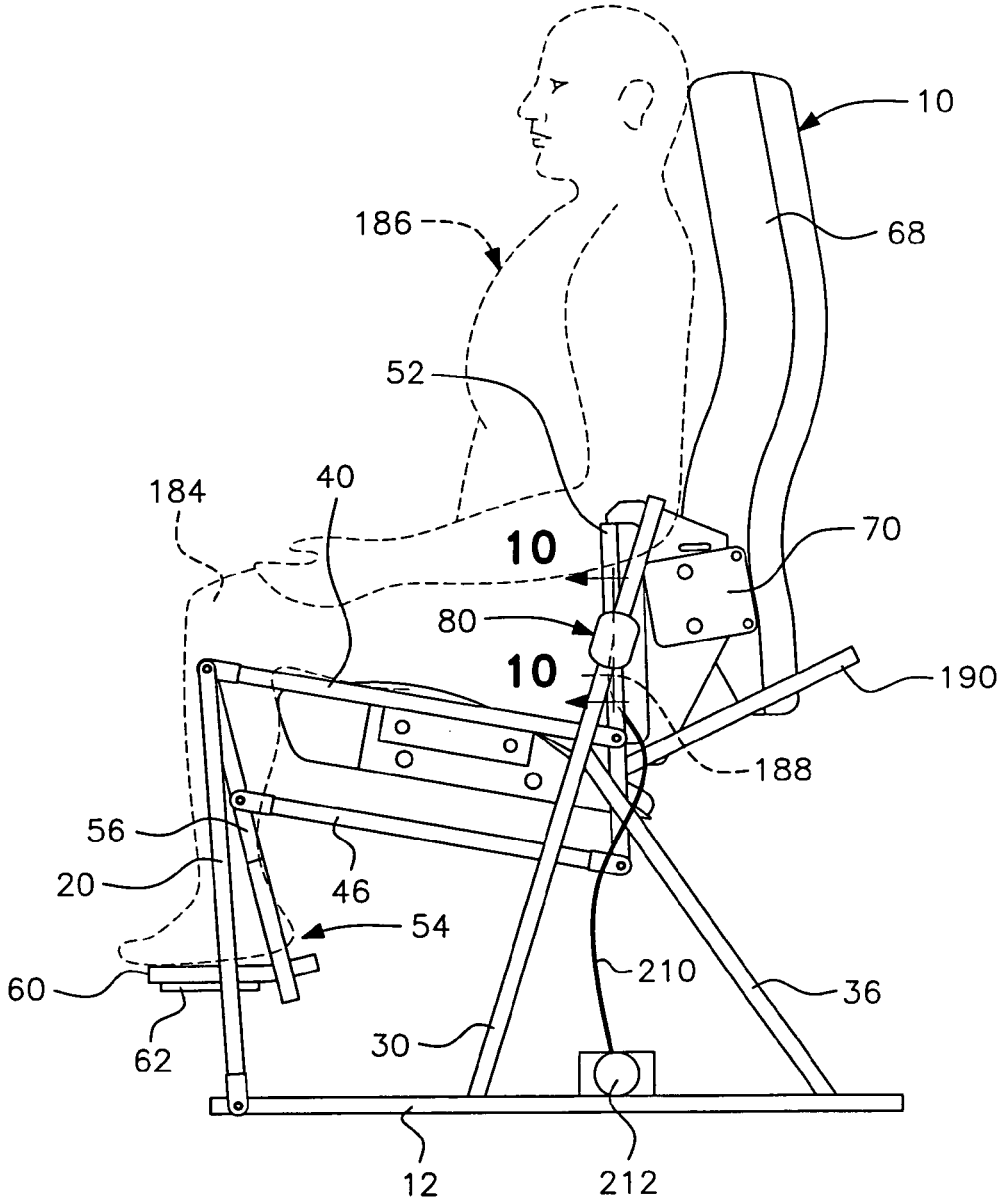
FIG. 8 is a schematic side elevational view of the exercise chair of the embodiment shown in FIGS. 1–4, with motorized adjustment, and illustrating the position of the components of the chair as a user gains access to or exits from the chair.
Figure 9:
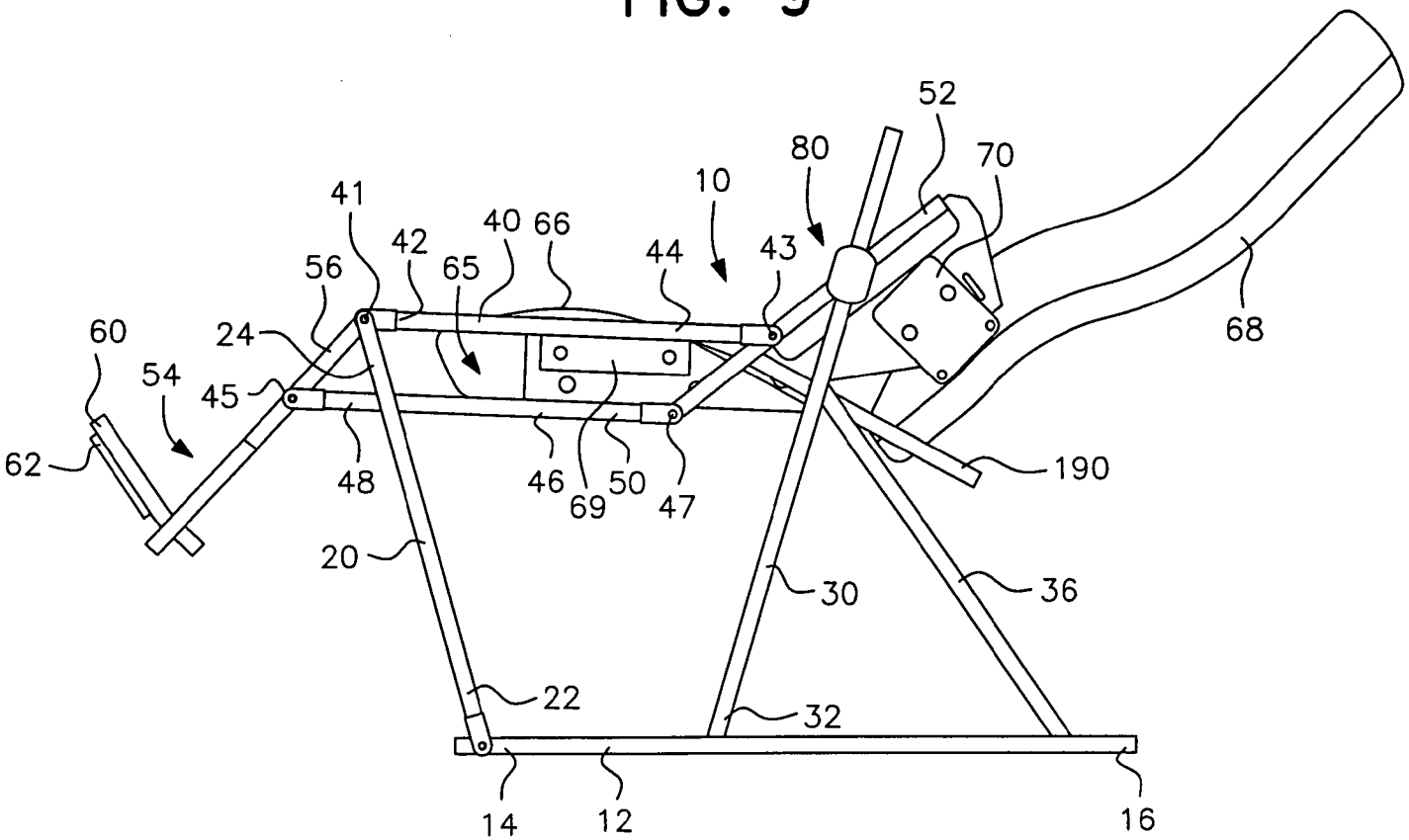
FIG. 9 is a schematic side elevational view of the chair of FIG. 8 illustrating the components in the extreme reclined position of the seat back with the foot rest elevated.
Figure 10:
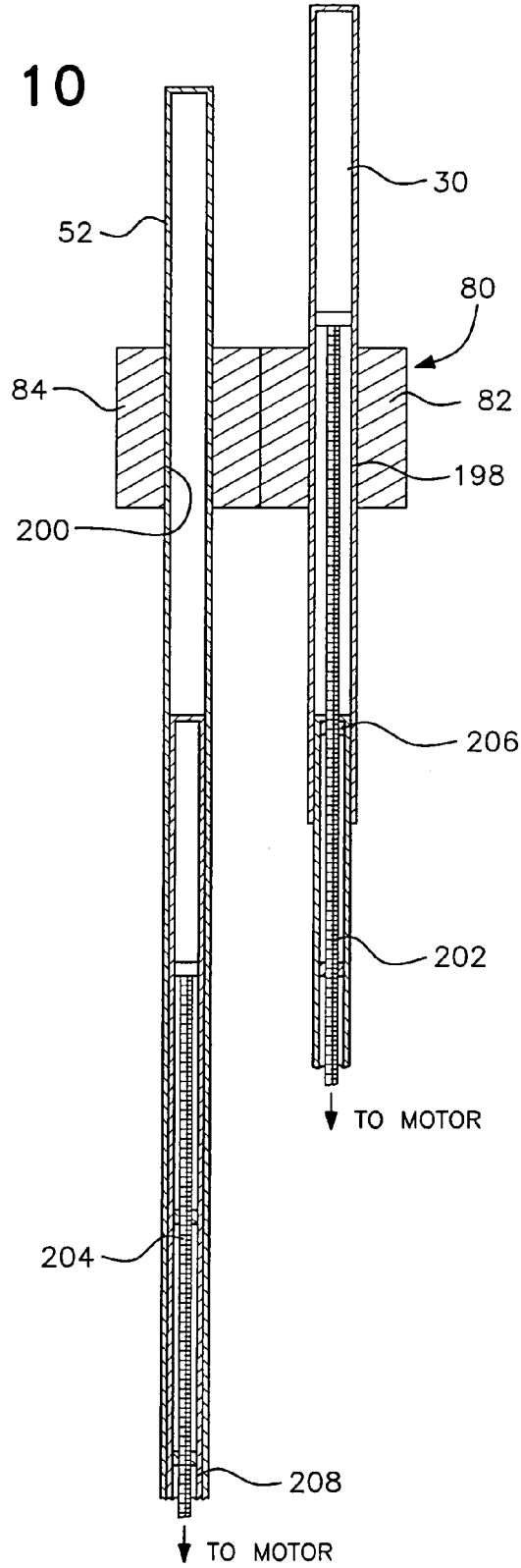
FIG. 10 is a schematic sectional view of the screw jacks used in the embodiment of FIG. 8, which move the fulcrum point between the stationary upstanding rear support members and the pivotal support arms connected to the seat back and the rearward ends of the parallelogram linkage in order to adjust the relative position of the fulcrum point equally in relation to the stationary rear support members and the support arms.

Turning now to FIGS. 8–10, the exercise chair 10 is shown in an upright condition with a user positioned therein. Shown are the supporting member 12, forward support legs 20 pivotally connected to the forward ends 14 of the members 12 at pivot point 146. Intermediate the length of the members 12 which constitute the supporting base, a pair of rear legs 30 extend upwardly from the members 12 and are braced by a pair of inclined rear legs 36 thus forming an A-frame structure rigid with the members 12. The seat assembly 65 is supported from the front legs 20 and the A-frame defined by the legs 30 and 36 and includes a cushioned seat 66 and a cushioned seat back 68. The seat 66 is supported from an upper arm 40 by bracket structure 69. The forward end of the upper arm 40 is pivotally connected to the upper end of front leg 20 at pivot point 41. Also pivoted to the forward end of the upper arm 40 of the parallelogram linkage is depending support members 56 for a foot board or foot rest 60 in order for the front legs 20, upper arms 40 and foot rest 60 to pivot in relation to each other and move in relation to the supporting members 12. Spaced below and generally parallel to the upper arm 40 is a lower arm 46 of the parallelogram linkage which has a forward end pivotally connected to the foot rest members 56 at pivot 45.

The rearward ends of the upper arm 40 and lower arm 46 of the parallelogram linkage are connected to a support arm 52 at pivot points 43 and 47 which cooperate with the support arms 52 to maintain the parallelogram linkage. The parallelogram linkage is thus defined by upper arm 40, lower arm 46, the portion of the support arm 52 between pivot points 43 and 47 at the rear of arms 40 and 46 and the foot rest support member 56 between pivot points 41 and 45 at the front of arms 40 and 46.

As also illustrated in FIGS. 8 and 9, the seat back 68 of the seat assembly is rigidly connected to the upper end portions of the support arms 52 by bracket structure 70 constructed to enable adjustment of the relative position of the seat back 68 to the seat 66 to adapt the seat assembly to users of different sizes.

As illustrated in FIG. 8, the pivot point 41 connecting the forward end of the upper arm 40, the front leg support 20 and the foot rest support 60 is located adjacent to and generally in alignment with the anatomical axis of pivotal movement of the knees 184 of a user 186 of the exercise chair.

As illustrated in FIGS. 8 and 9, the support arms 52 which supports the seat 66 through the parallelogram linkage defined by the upper arm 40 and lower arm 46 and which supports the seat back 68 by the brackets 70 pivotally support these components from the A-frame defined by legs 30 and 36 of the support base by a fulcrum pivot or bearing assembly generally designated by reference numeral 80. The fulcrum pivot or bearing assembly 80 are located above the apex of the A-frame on the portion of the upper end of member 30 which extends above support member 36 as clearly illustrated in FIG. 9. The fulcrum or bearing 80 pivotally interconnects the intersecting support arms 52 and the upper ends of members 30. This arrangement enables the seat assembly including the seat back 68, seat 66, upper arm 40, lower arm 46, front legs 20 and foot rest members 56 to pivot between the upright position of the seat assembly, as illustrated in FIG. 8, to a fully reclined position, as illustrated in FIG. 9.

The components as described will normally be in the upright position of FIG. 8 when no user occupies the chair. The weight that may occur depending upon the position of the bearing or fulcrum 80 is counterbalanced by the added weight 62 on the footboard 60. This position enables a user to step upon the footboard 60 when gaining access to the seat assembly since the weight of the footboard 60 and weight 62 will exert a force on the footrest members 54 to pivot in a counter clockwise direction as shown in FIGS. 8 and 9. Also, when a user is positioned in the chair the user's weight on the seat 66 is suspended from the fulcrum or bearing 80 so that the support arms 52 tend to depend vertically from the fulcrum 80 thus providing a stable arrangement when a user sits on the seat 66 and when a user exits from the chair.

The user's hip joint 188 is located adjacent to and generally in alignment with the pivot axis 43 between the upper arm 40 of the parallelogram linkage and the support arm 52 as illustrated in FIGS. 8 and 9. As illustrated in FIGS. 3 and 8, the support arms 52 are interconnected by a rigidifying U-shaped member 190 which has the ends of the legs thereof attached to the support arms 52 to maintain the support arms in rigid relation to each other at points spaced from the brackets 70.

FIG. 10 illustrates schematically a motor-driven structure for the fulcrum pivot or bearing assembly 80 which includes a pair of bearing blocks 82 and 84 which are mounted on the support arm 52 and the upper end portion of the support member 30. The bearing blocks 82 and 84 are pivotally interconnected for unitary sliding motion in relation to the support arm 52 and the upper end of member 30 on each side of the chair. Each of the members 30 and 52 are tubular and extend through passageways 198 and 200 in the bearing blocks 82 and 84 for relative sliding movement along the support arm 52 and the support member 30. Each of the members 52 and 30 include a jack screw 202 and 204 each having a lower end for connection with a flexible drive shaft 210 driven by a motor 212 schematically illustrated in FIG. 8. The jack screws 202 and 204 are threadedly engaged with threaded nuts 206 and 208 at the lower ends of the support arms 52 and support member 30. As such, rotational movement of the jack screws 202 and 204 will cause unitary movement of the bearing blocks 82 and 84 along the tubular members 52 and 30. Hence, the position of the fulcrum pivot and bearing assembly 80 can be simply adjusted.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A method of exercising in an exercise chair having a generally horizontally supported seat, a pivot linkage connected to the seat, a front leg support connected to said linkage to determine a chair knee joint axis, a rear back support connected to said linkage to define a chair hip joint axis, a seat back, and a fulcrum pivot spaced above said chair hip joint axis and connected to said seat back and said linkage, said method comprising the steps of:

occupying the chair by a user when said seat back is in an upright position;

positioning the user's anatomical knee joints generally in alignment with said chair knee joint axis;

positioning said user's anatomical hip joints generally in alignment with said chair hip joint axis;

exerting a rearward force on said seat back to rotate said front leg support about said knee joint axis from an at rest position to a raised position and said seat back about said fulcrum pivot from said upright position to a backward inclined position; and relaxing said rearward force to enable said front leg support to pivot back to said at rest position and return said seat back to said upright position.

2. The method as claimed in claim 1, further including the step of weighting said front leg support to offset a weight of said seat back.

3. The method as claimed in claim 1 wherein said exerting of a rearward force on said seat back is low resistance.

4. The method as set forth in claim 3 wherein said exerting and said relaxing of said rearward force can be carried out at a high frequency without tiring the user.

5. A method of exercising which comprises the steps of:

positioning a user in an exercise chair with the user's knee joints substantially aligned with a chair knee joint axis;

at the same time positioning the user's hip joints substantially aligned with a chair hip joint axis; and alternately exerting and relaxing a rearward force on said seat back by said user to rotate a chair front leg support about said knee joint axis between an at rest position and a raised position and rotate said seat back about a fulcrum pivot between an upright position and a backward inclined position.

6. The method as claimed in claim 1, further including the step of exerting a force on said front leg support at the same time and generally opposite to said rearward force exerted on said seat back.

7. The method as claimed in claim 6 wherein said front leg support includes a foot rest for receiving the user's feet and said force exerted on said front leg support is against said foot rest by said user's feet.

8. The method as claimed in claim 1, further including the step of positioning said fulcrum pivot approximately 3–9 inches above said chair hip joint axis.

9. A method of operating an exercise chair having a generally horizontally supported seat, a pivot linkage connected to the seat, a front leg support connected to said linkage to determine a first pivot axis, a seat back, and a fulcrum pivot connected to said seat back and said linkage to define a second pivot, said method comprising the steps of exerting a rearward force on said seat back and at the same time a generally opposite force on said front leg support to rotate said front leg support about said first axis from an at rest position to a raised position and rotate said seat back about said, second pivot between an upright position and a backward inclined position, relaxing said forces, and alternately exerting and relaxing said forces.

10. A method of exercising in an exercise chair having a generally horizontally supported seat, a pivotal front leg support, and a seat back, said method comprising the steps of:

a user occupying the chair seat with the weight of the user pivoting said seat back to an upright position;

positioning the user's anatomical knee joints generally in alignment with a chair knee joint axis defined by a pivotal connection between a front end of a pivot link connected to and supporting said seat and said pivotal front leg support;

positioning said user's anatomical hip joints generally in alignment with a chair hip joint axis defined by a pivotal connection between a rearward end of said link and a rigid rear support;

the user in said seat exerting a rearward force on said seat back to move said link toward said front leg support from an at rest upright position and said seat back about a fulcrum pivot from an upright position to a backward inclined position; and relaxing said rearward force on the seat back to enable weight on said seat to return said seat back to said upright position.

11. The method as defined in claim 10, wherein said chair includes a foot rest pivotally supported from an upper end of said pivotal front leg support and depending therefrom, a second pivot link parallel to and below said seat supporting link, a forward end of said second link being pivotally connected to said foot rest below said chair knee joint axis, a rearward end of said second link being pivotally connected to said seat back at a point below the pivotal connection between the rearward end of said seat supporting link and said seat back to form a fulcrum axis supporting the rearward end of said links, said pivotal connection between the seat back and rear support being adjustable along both the seat back and rear support to adjust the distance between the fulcrum axis and pivotal connections between the seat back and rearward ends of said links to vary the force required to move said seat and seat back forwardly and rearwardly wherein the seat occupant applies and relaxes forces on the seat and seat back with the weight of the occupant returning the chair to upright position.

12. An exercise chair comprising a pair of laterally spaced, stationary upstanding rigid rear supports, a pair of laterally spaced upstanding front supports pivotal about a transverse axis at a lower end thereof, a pair of laterally spaced, generally horizontal supporting arms having a seat supported therefrom, a first pivot connecting a forward end of each of said arms to the upper end of said front pivotal support, a seat back connected to a rearward end of said arms by a second pivot, and a third pivot connecting the upper end of each of said rigid rear supports and said seat back, said third pivot located at a position spaced above said second pivot, said third pivot being adjustable in relation to said seat back and said rigid rear supports to adjust the distance between said second and third pivots to vary the force required to move the seat and seat back between upright and reclined positions when exerting a rearward force on said seat back and to move said arms and seat forwardly about the second pivot and to pivot the upper end of said front supports about the transverse axis at their lower ends, with relaxation of said force enabling an occupant's weight on the seat to return said seat and seat back to an upright position.

13. An exercise chair comprising an upstanding rigid rear support, an upstanding front support pivotal about a transverse axis at a lower end thereof, a supporting arm having a seat supported therefrom, a first pivot connecting a forward end of said arm to the upper end of said front pivotal support, a seat back connected to a rearward end of said arm by a second pivot, and a third pivot connecting the upper end of said rigid rear support and said seat back, said third pivot located at a position spaced above said second pivot, said third pivot being adjustable in relation to said seat back and said rigid rear support to adjust the distance between said second and third pivots to vary the force required to move the seat and seat back between upright and reclined positions when exerting a rearward force on said seat back and to move said arm and seat forwardly about the second pivot and to pivot the upper end of said front support about the transverse axis at its lower end, with relaxation of said force enabling an occupant's weight on the seat to return said seat and seat back to an upright position, and a foot rest pivotally supported from said first pivot in depending relation thereto, a second supporting arm below said seat supporting arm and having a forward end connected to said foot rest at a fourth pivot below said first pivot, said second arm including a rearward end pivotally connected to said seat back at a fifth pivot below said second pivot to form a parallelogram linkage for pivoting the foot rest in response to pivotal movement of the seat back.

14. An exercise chair as claimed in claim 12 wherein one of said rear supports and one of said arms includes a lock structure in spaced relation to said second and third pivots to lock said arms, seat and seat back in stationary adjusted positions.

* * * * *